United States Patent [19]

Ritchie et al.

[11] Patent Number: 4,460,166

[45] Date of Patent: Jul. 17, 1984

[54] METHOD OF REMOVING DROSS FROM A LEAD REFINING POT

[75] Inventors: Duncan Ritchie, Glasgow, Scotland; John R. Mills, Newcastle-upon-Tyne; William R. D. Couper, Tyne & Wear, both of England

[73] Assignee: Associated Lead Manufacturers Ltd., Newcastle-upon-Tyne, England

[21] Appl. No.: 464,003

[22] Filed: Feb. 4, 1983

[30] Foreign Application Priority Data

Feb. 11, 1982 [GB] United Kingdom ..... 8203987

[51] Int. Cl.[3] ..... F27D 3/15

[52] U.S. Cl. ..... 266/228; 75/24; 75/78; 266/232

[58] Field of Search ..... 266/227–232, 266/235; 75/24, 78

[56] References Cited

U.S. PATENT DOCUMENTS 4,073,481 2/1978 Lawson ..... 266/228

FOREIGN PATENT DOCUMENTS 0039035 11/1981 European Pat. Off. ..... 266/228

*Primary Examiner*—M. J. Andrews

*Attorney, Agent, or Firm*—Watson, Cole, Grindle & Watson

[57] ABSTRACT

Dross is removed from molten lead during its refining by scraping the dross by means of a rake up a ramp fitted to the rim of the refining pot, a baffle being placed to trap dross in front of the ramp. The rake may be operated manually or by means of a power operated device.

4 Claims, 5 Drawing Figures

METHOD OF REMOVING DROSS FROM A LEAD REFINING POT

Figure 1:
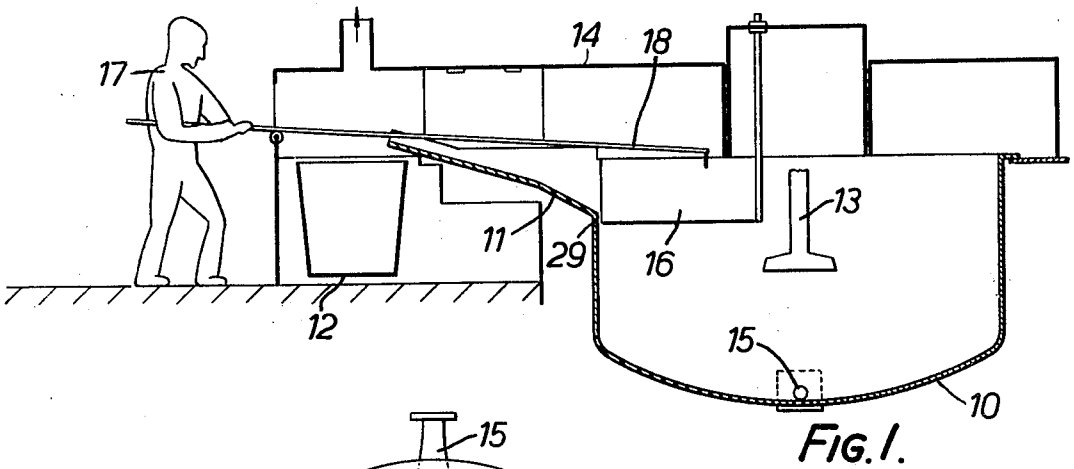

In the refining of lead it is often necessary to remove from molten lead, contained in a pot fitted with a stirrer and a hygiene cover, impurities such as copper, tin, antimony and arsenic. The impurities are removed in succession by addition to the molten lead of a reagent capable of reacting with the impurity to form a dross which floats on the surface of the lead. During the refining the stirrer acts to distribute the reagent in the lead.

The impurities may be removed in succession from the same charge of lead, e.g. 100 tonnes, while it remains in the same pot. Alternatively the first impurity may be removed in a first pot and the lead transferred to other pots for individual removal of the other impurities.

In either case, it is often necessary to add more than one charge of reagent to the lead for removal of each impurity and the dross must be removed from the surface of the lead before each such addition and also before the refined lead is tapped from the pot. The final stage before tapping normally involves adding caustic soda to the lead to clean it up by removing final traces of the above impurities and also any remaining arsenic present and this caustic dross must be removed before tapping.

Hitherto the dross has usually been removed by two men, one using a pusher to push dross across the surface of the metal to another equipped with a perforated spoon, which he manipulates to scoop up the dross and, after the entrained lead has drained back into the pot, to discharge the dross into a dross box. Owing to the limited opening in the hygiene cover available for manipulating the implements, a dead area frequently exists which is not accessible to either implement and from which the dross cannot therefore be easily removed. This can result in incomplete removal of the dross with consequent cross contamination of the dross during any subsequent refining stage. In addition this procedure imposes severe physical demands on both workmen.

The present invention provides an improved procedure for removing the dross which comprises scraping the dross by means of a rake up an upwardly inclined and outwardly extending ramp fitted to the rim of the pot while a removable baffle is so positioned that it extends inwardly from the ramp, downstream of the current produced by rotation of the stirrer, to trap dross at a location in front of the ramp. Preferably the removable baffle extends in alignment with one side of the ramp towards the centre of the pot. While the baffle extends downwardly to some extent into the molten lead, it must of course be so disposed as not to interfere with the action of the stirrer.

This procedure permits manual removal of virtually all of the dross by a single workman, the lead draining back into the pot as the dross is drawn up the ramp by the rake. The rake is preferably provided with slots to assist in the draining of lead from the dross. The angle of inclination of the ramp is preferably in the range of 10°–30°. The slope may be steeper at the end of the ramp adjoining the pot than at its outer end.

Preferably provision is made for running the stirrer at a slower speed than normal during dross removal to avoid formation of excessive dross.

The procedure so far described involves modification of the conventional lead refining pot by addition of the ramp and the removable baffle. As already mentioned it can be performed manually by a single workman.

The invention also provides, as more fully explained later, for powered operation of the rake which draws the dross up the ramp. In this case, no manual labour is required other than switching on, when required, the mechanism for operating the rake. With powered operation of the rake, it is however possible to remove the dross without the use of a baffle by stopping the stirrer and pushing the dross manually towards the ramp.

Figure 2:
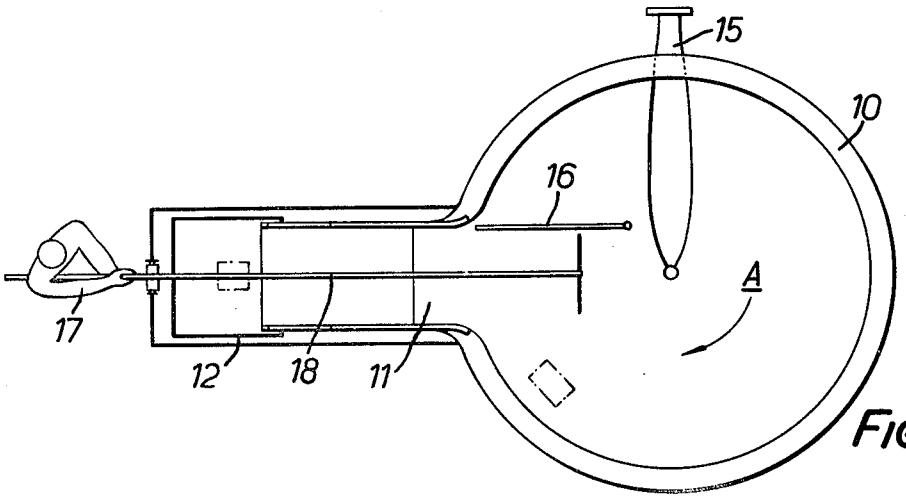
Figure 3:
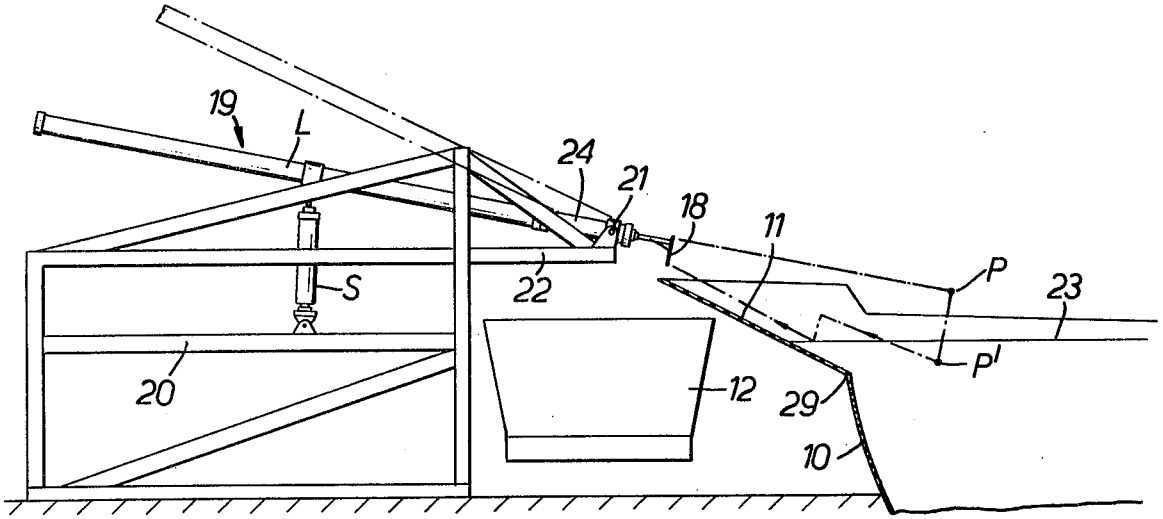
Figure 4:
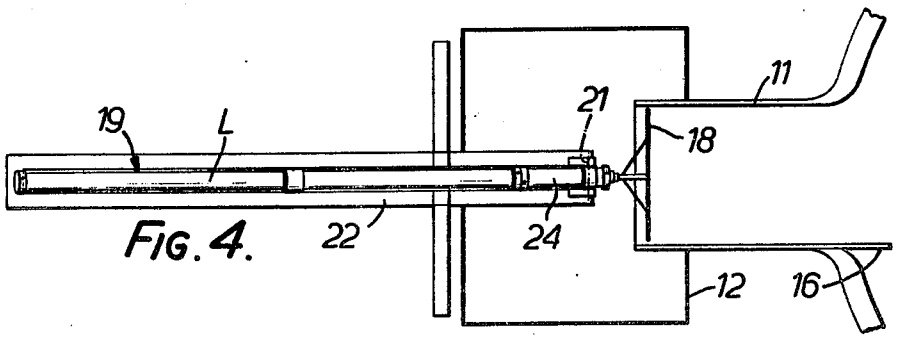
Figure 5:
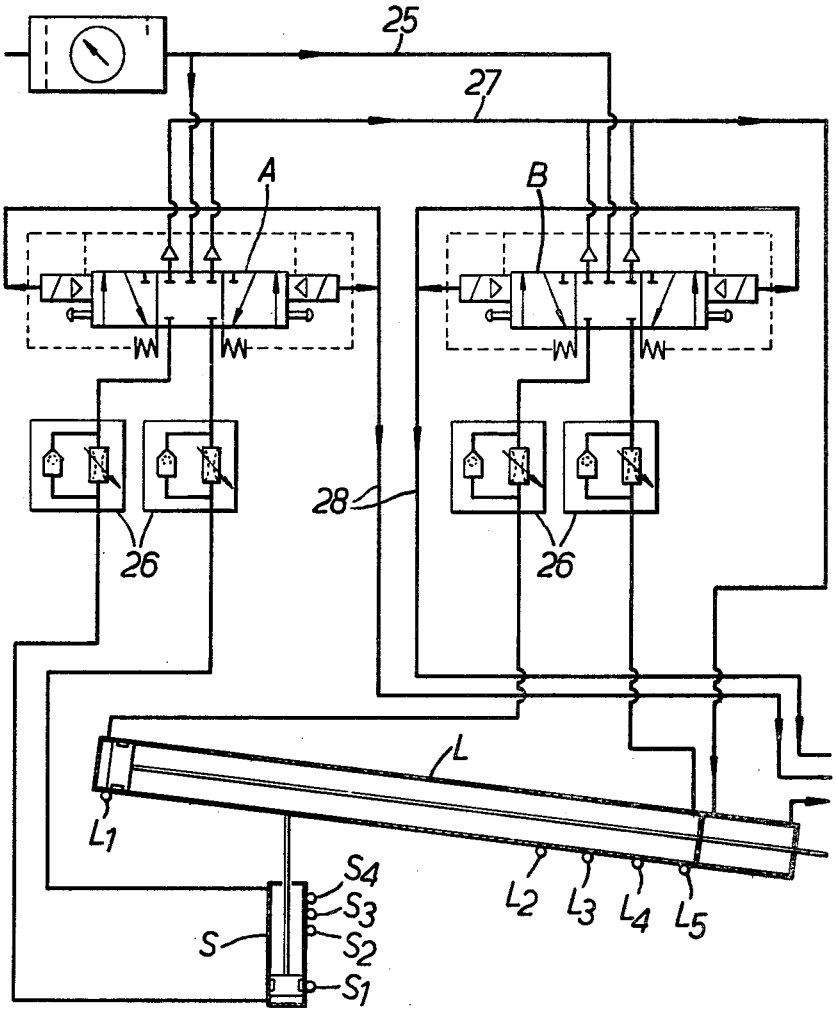

The invention will now be further explained with reference to the accompanying diagrammatic drawings, in which:

FIG. 1 is a sectional side elevation of a refining pot providing for manual dross removal, FIG. 2 is a corresponding plan view, partly in section, FIG. 3 is a side elevation of a refining pot providing for powered dross removal, FIG. 4 is a corresponding plan view, and FIG. 5 is a diagram showing part of an associated control system.

Like reference numerals indicate like parts throughout the Figures.

As shown in FIGS. 1 and 2, the pot 10, in which molten lead is circulated in the direction indicated by the arrow A by a power-operated stirrer 13, is fitted with a ramp 11, the upper end of which is disposed above a dross box 12. The pot 10 is provided with a hygiene cover 14 and a tapping spout 15. During dross removal a removable baffle 16 is placed in the pot 10 in the position shown so as to cause dross to accumulate in front of the ramp 11. The baffle 16 extends above the surface of the dross and downwardly into the lead, e.g. by 6 inches.

Dross is scraped up the ramp 11 by a workman 17 using a rake 18.

The apparatus shown in FIGS. 3 and 4 is generally similar but in this case the rake 18 is operated by a power unit 19 mounted on a platform 20. The power unit 19 consists of two pneumatic cylinders L and S, the rake 18 being fitted to the piston rod of the longer cylinder L.

The cylinder L is pivoted at 21 to a frame member 22, and is movable about the pivot 21 by the shorter cylinder S, the piston rod of which is pivoted to the cylinder L and which is pivoted at its lower end and to the platform 20.

In use the rake 14 is caused under automatic control, as described below, to move in the path shown in chain lines in FIG. 3, performing successive cycles of operation under the joint control of the two cylinders in which it is first projected to the point P, then lowered to the point P′ just below the lead level 23 and then moved in the path indicated and finally up the ramp 11.

To prevent the leverage produced by full extension of the piston rod from exerting an excessive force on the front end bearing of the pneumatic cylinder L, the latter has a cylindrical front extension 24 which provides support at both ends for its piston rod. Air expelled from the cylinder L is passed through the extension 24 to cool it. The front seal of the extension 24 also serves to exclude dust from the cylinder L.

As shown in FIG. 5, the flow of air to the cylinders L, S is effected by solenoid controlled valves A and B, the solenoids being operated under control of an electronic controller and of magnetic reed switches $L_1$–$L_5$ associated with the cylinder L and $S_1$–$S_4$ associated with the cylinder S which sense the travel of pistons of magnetic material within the cylinders. The controller can be programmed in accordance with the level of the lead in the pot, and the motions and number of strokes required of the rake 18 to deal with any particular dross. The power unit can, of course, be used with lead refining pots of different size and capacity and, when installed, those reed switches are selected for use which will impart to the rake the stroke appropriate for the particular pot with which the power unit is to be used. The controller may also provide for automatic switching of the stirrer 13 to slower speed and positioning and removal of the baffle 16. A safety device may be incorporated for automatically stopping operation of the rake in case of emergency.

As shown in FIG. 5, pressurised air is admitted to the valves A and B through a line 25 and air is passed from the valves A and B to the cylinders S and L respectively through flow regulators 26 and air is exhausted from the valves A and B through lines 27 and 28.

The following is a typical cycle of operations and under control of the electronic controller:

1. Retract cylinder S to sensor 1, valve A moved to right.
2. Retract cylinder L to sensor $L_1$, valve B moved to right.
3. Extend cylinder L to sensor $L_2$($L_3$,$L_4$or $L_5$), valve B moved to left.
4. Extend cylinder S to sensor $S_2$ ($S_3$ or $S_4$), valve A moved to left.
5. Retract cylinder L for time $t_1$ (if cylinder L extended to $L_5$).
6. Retract cylinder L and extend cylinder S for time $t_2$ (if cylinder L extended to $L_5$).

7 & 8. As steps 5 & 6 (if cylinder L extended to $L_5$ or $L_4$)

9 & 10. As steps 5 & 6 (if cylinder L extended to $L_5$,$L_4$ or $L_3$).

11. Retract cylinder L for time $t_1$.
12. Retract cylinder L to sensor $L_1$ whilst extending cylinder S.
13. Retract cylinder S to sensor $S_1$.
14. Back to step 1.

Preferably the ramp 11 merges with the wall of the pot 10 with a rounded shoulder at the point 29.

The invention thus provides a novel manual or automatic system for removing dross from a lead refining pot and also a novel fluid pressure operated device for imparting compound movements to a tool of the kind shown in FIGS. 3 and 4. As will be appreciated the cylinders of the tool could be operated hydraulically if desired.

The apparatus described has been found effective to remove drosses and can cater for substantial variations in the level of the lead within the pot. The width of the rake is preferably 9–24 inches and its height is preferably 6 inches.

In a typical refining operation a 60 tonne pot was used to receive hot metal directly from two smelting furnaces. The first stage process in secondary lead refining was carried out in this pot. A drossing machine as shown in FIGS. 3 and 4 was fitted to this pot and a typical refining sequence is shown below. 15 tonnes of lead at 900° C. were tapped into the pot which contained 45 tonnes of metal at 450° C. 10 to 20 kgs of sawdust were added and stirred into the dross which forms (due to cooling the incoming metal) for around 15 minutes. (The stirrer revolved at 320 rpm). Approximately 1 tonne of dross was formed containing some copper, slag and around 70% lead. The temperature of the metal had fallen to around 500° C. The drossing machine was then used to remove this dross. The stirrer is used to bring dross around to the baffle, where it is trapped and removed by the rake. 1 tonne of dross was removed in 10 minutes. (It would take 20 to 25 minutes to carry out this operation by hand). The lead was allowed to cool to 450° C. and then 15 tonnes of lead was pumped out to be transferred to the next pot where subsequent refining was carried out.

We claim:

1. A lead refining pot for containing a batch of molten lead to be refined and including a stirrer for stirring the lead in the pot, comprising a ramp fitted to the rim of the pot and extending upwardly and outwardly from said rim in combination with a rake, power-operated mechanism external to the pot for operating said rake to scrape dross from the surface of the lead in the pot and up the ramp, and a controller for said power-operated mechanism for varying operation thereof in accordance with variations in the level of lead within the pot.

2. A lead refining pot according to claim 1, further comprising a baffle within the pot positioned to trap dross at a location in front of the ramp.

3. A lead refining pot according to claim 1, wherein said power-operated mechanism comprises a first fluid pressure operated cylinder positioned longitudinally of and above the ramp, said cylinder having a piston rod connected to and operable to impart longitudinal movement to the rake and being pivoted at its forward end to a stationary support, a second fluid pressure operated cylinder positioned beneath the first cylinder and operable to move the first cylinder about its pivot to impart up and down movements to the rake, and wherein said controller controls admission of fluid under pressure to said cylinders to cause the rake to perform in repetition a forward movement to a position above dross in the pot, a downward movement into a position below dross in the pot and a return movement to scrape dross up the ramp.

4. A lead refining pot according to claim 3, in which the first cylinder has a cylindrical front extension which affords support at both ends for said piston rod.

* * * * *